US007002535B2

(12) United States Patent
Onozawa et al.

(10) Patent No.: US 7,002,535 B2
(45) Date of Patent: Feb. 21, 2006

(54) DISPLAY APPARATUS

(75) Inventors: Makoto Onozawa, Yokohama (JP); Yuji Sano, Zushi (JP); Michitaka Ohsawa, Fujisawa (JP); Takashi Sasaki, Hiratsuka (JP); Noboru Akiyama, Hitachinaka (JP); Fumitaka Asami, Kunitachi (JP); Kazuo Yoshiikawa, Kobe (JP); Hitoshi Hirakawa, Takasago (JP); Tomokatsu Kishi, Yamato (JP); Toyoshi Kawada, Atsugi (JP)

(73) Assignees: Hitachi, Ltd., Tokyo (JP); Fujitsu Limited, Kawasaki (JP)

( * ) Notice: Subject to any disclaimer, the term of this patent is extended or adjusted under 35 U.S.C. 154(b) by 0 days.

(21) Appl. No.: 10/866,302

(22) Filed: Jun. 14, 2004

(65) Prior Publication Data

US 2004/0257309 A1 Dec. 23, 2004

Related U.S. Application Data

(63) Continuation of application No. 10/320,550, filed on Dec. 17, 2002, now Pat. No. 6,781,564, which is a continuation of application No. 09/608,150, filed on Jun. 30, 2000, now Pat. No. 6,496,166.

(30) Foreign Application Priority Data

Jun. 30, 1999 (JP) ..... 11-185812

(51) Int. Cl.
*G09G 3/28* (2006.01)

(52) U.S. Cl. ..... 345/60; 345/63; 315/169.1

(58) Field of Classification Search ..... 345/60, 345/68, 63, 67, 77–80; 315/169.1–169.3
See application file for complete search history.

(56) References Cited

U.S. PATENT DOCUMENTS

| | | | | |
|---|---|---|---|---|
| 4,737,687 | A | 4/1988 | Shinoda et al. | |
| 5,517,207 | A | 5/1996 | Kawada et al. | |
| 5,654,728 | A * | 8/1997 | Kanazawa et al. | 345/68 |
| 5,745,086 | A | 4/1998 | Weber | |
| 5,786,794 | A | 7/1998 | Kishi et al. | |
| 5,790,087 | A * | 8/1998 | Shigeta et al. | 345/67 |
| 5,828,353 | A | 10/1998 | Kishi et al. | |
| 6,011,355 | A * | 1/2000 | Nagai | 315/169.3 |
| 6,034,482 | A | 3/2000 | Kanazawa et al. | |
| 6,100,859 | A * | 8/2000 | Kuriyama et al. | 345/60 |
| RE37,444 | E | 11/2001 | Kanazawa | |
| 6,414,653 | B1 | 7/2002 | Kobayashi | |
| 6,496,166 | B1 * | 12/2002 | Onozawa et al. | 345/60 |
| 6,781,564 | B1 * | 8/2004 | Onozawa et al. | 345/60 |

* cited by examiner

*Primary Examiner*—Regina Liang
*Assistant Examiner*—Jennifer T. Nguyen
(74) *Attorney, Agent, or Firm*—Antonelli, Terry, Stout and Kraus, LLP.

(57) ABSTRACT

A display apparatus includes a display panel including address electrodes and sustain electrodes crossing the address electrodes, with pixels being sandwiched between the address electrodes and the sustain electrodes. A sustain-electrode drive circuit selectively generates both sustain pulses and scan pulses and supplies them to the sustain electrodes. An address-electrode drive circuit generates address pulses based on a video signal and supplies the address pulses to the address electrodes. A control-signal generation circuit generates a control signal for controlling the sustain-electrode drive circuit to generate a selected one of the sustain pulses and the scan pulses and supplies the control signal to the sustain-electrode drive circuit. In order to display an image on the display panel, the sustain-electrode drive circuit both specifies addresses of pixels to be turned on and turns on the pixels at the specified addresses.

2 Claims, 8 Drawing Sheets

1 SUB-FIELD
RESET PERIOD
SCAN PERIOD
SUSTAIN PERIOD

VX

VY1

VY2

VA1

VA2

DY1

DYn

DYS

DYS1

DYSn

VCC
VSCN
VSY

VSCN
VSCN
0

VSY

V49

V50

DISPLAY APPARATUS

REFERENCE TO RELATED APPLICATIONS

This application is a continuation of application Ser. No. 10/320,550 on Dec. 17, 2002, now U.S. Pat. No 6,781,564 issued Aug. 24, 2004, which is a continuation of application Ser. No. 09/608,150 filed on Jun. 30, 2000, now U.S. Pat. No. 6,496,166 issued Dec. 17, 2002, the contents of which are hereby incorporated herein by reference in their entirety.

BACKGROUND OF THE INVENTION

The present invention relates to a display apparatus such as a plasma display apparatus. More particularly, the present invention relates to a configuration of a circuit for driving a display unit.

A variety of conventional display apparatuses are known. One of them is a plasma display apparatus. A plasma display apparatus reproduces an image by driving a fluorescent material to emit light in an electrical discharge phenomenon. In a plasma display apparatus, a large screen can be implemented in a small space. Thus, the plasma display apparatus is a future display apparatus which draws attention.

FIG. 2 is a block diagram showing a typical configuration of the conventional plasma display apparatus. In the figure, reference numerals 3 and 8 denote a plasma display panel and a first-electrode drive circuit respectively. Reference numeral 27 denotes a drive circuit whereas reference numerals 25 and 26 each denote a power MOSFET. A symbol X denotes a first electrode or an X electrode common to the power MOSFETs 25 and 26. A sustain power supply is connected to a terminal 7. Reference numeral 10 denotes an address drive circuit. Symbols A1 to AN each denote an address electrode. Reference numerals 82 and 33 denote a second-electrode sustain circuit and a drive circuit respectively. Reference numerals 31 and 32 each denote a power MOSFET whereas symbols Y1 to Yn each denote a second electrode. A sustain power supply of the second electrodes Y1 to Yn is connected to a terminal 29. Reference numeral 34 denotes a scan drive circuit which comprises first to nth sustain drive circuits 34*a* to 34*n*. The outputs of the first to nth sustain drive circuits 34*a* to 34*n* are connected to the second electrodes Y1 to Yn. The scan drive circuit 34 comprises a shift register 36, logic circuits 35 and 37, constant-current power supplies 39 and 47, power MOSFETs 38, 40, 42, 43, 46, 48, 50 and 51, resistors 41 and 49 as well as diodes 44, 45, 52, 53 and 80. A scan power supply is connected to a terminal 28, furnishing power to the scan drive circuit 34 by way of a diode 80. Reference numeral 11 denotes a waveform control circuit for outputting control signals Dxs, Dad and Dys to a first-electrode drive circuit 8, an address drive circuit 10 and a second-electrode sustain circuit 82 respectively. The waveform control circuit 11 also supplies a control signal Dscn to the scan drive circuit 34 by way of an insulation circuit 30. A second drive circuit 81 comprises the second-electrode sustain circuit 82 and the scan drive circuit 34.

In the plasma display apparatus shown in FIG. 2, the scan signal Dscn output by the waveform control circuit 11 is supplied to the shift register 36 employed in the scan drive circuit 34*n* by way of the photo-coupler insulation circuit 30. The shift register 36 sequentially distributes the scan signal Dscn to the scan drive circuits 34*a* to 34*n*. In the scan drive circuit 34, scan pulses bases on the scan signal Dscn are sequentially supplied to the second electrodes Y1 to Yn of the plasma display panel 3.

The second-electrode sustain circuit 82 generates sustain pulses YS based on the sustain pulses Dys output by the waveform control circuit 11. The sustain pulses YS are supplied to the second electrodes Y1 to Yn of the plasma display panel 3. The sustain pulses YS generated by the second-electrode sustain circuit 82 are also supplied to the second electrodes Y1 to Yn by way of a common terminal 83 of the scan drive circuit 34, the diode 45 and the diode 53.

The address signal Dad generated by the waveform control circuit 11 is supplied to an address drive circuit 10. The address drive circuit 10 outputs address drive pulses based on the address signal Dad to the address electrodes A1 to An of the plasma display panel 3.

The first-electrode drive signal DXS generated by the waveform control circuit 11 is supplied to a first-electrode drive circuit 8. The first-electrode drive circuit 8 outputs drive pulses based on the first-electrode drive signal DXS to the first electrode X of the plasma display panel 3. The scan drive circuit 34 is available in the market as a scan drive IC.

A conventional implementation of the plasma display apparatus shown in FIG. 2 is disclosed in U.S. Pat. No. 5,745,086. FIG. 10 of this U.S. patent is a block diagram showing a basic circuit for driving the plasma display apparatus.

In the plasma display apparatus shown in FIG. 2, the scan drive circuit 34 composing the second-electrode drive circuit and the second-electrode sustain circuit 82 employ circuits independent of each other. For example, the second-electrode drive circuit 34 has a configuration employing a scan drive IC having a circuit configuration shown in FIG. 2 while the second-electrode sustain circuit 82 has a configuration employing a power module. In addition, since the terminal 83 of the second-electrode sustain circuit 82 is floating off the ground, it is necessary to put the scan signal Dscn in a floating state through the insulation circuit 30.

Moreover, the circuit scale of the second-electrode drive circuit 34 is larger than the first-electrode drive circuit 8, resulting a big ratio of the second-electrode drive circuit 34 to the entire circuit of the plasma display apparatus. Accordingly, the second-electrode drive circuit 34 is a problem encountered in an effort made to reduce the size of the plasma display apparatus.

SUMMARY OF THE INVENTION

It is thus an object of the present invention addressing the problems described above to provide a display apparatus having a simple and compact configuration capable of avoiding malfunctions.

In order to achieve the object described above, the present invention provides the following:

1) A display apparatus for displaying an image on a display panel by turning on pixels of said display panel, the display apparatus comprising: said display panel provided with: address electrodes driven by address pulses based on a video input signal; and sustain electrodes crossing said address electrodes and sandwiching electrical discharging units of pixels with said address electrodes and driven by sustain pulses; a sustain-electrode drive circuit for generating said sustain pulses and scan pulses, provided with a common circuit for generating said sustain pulses or said scan pulses in response to an operating state thereof and for supplying said scan pulses and sustain pulses to said sustain electrodes; an address drive circuit for generating and outputting said address pulses; and a control-signal generation circuit for generating a control signal for changing said operating state of said sustain-electrode drive circuit, wherein, in order to display an image on said display panel, an address of a pixel on said display panel is specified by an electric field created between said sustain electrodes and said address electrodes by said scan pulses and said address pulses; a pixel on said display panel at an address specified by an electric field of said sustain electrodes created by said sustain pulses is turned on; and said sustain-electrode drive circuit is used for both specifying said address and turning on said pixel.

2) A display apparatus for displaying an image on a display panel by turning on pixels of said display panel, the display apparatus comprising: said display panel provided with address electrodes and, first and second electrodes parallel to each other crossing said address electrodes and sandwiching electrical discharging units of pixels with said address electrodes; a first-electrode drive circuit for generating first-electrode sustain pulses for driving said first electrodes; a second-electrode drive circuit for generating scan pulses and second-electrode sustain pulses for driving said second electrodes, provided with a common circuit for generating said second-electrode sustain pulses or said scan pulses in response to an operating state thereof and for supplying said scan pulses and said second-electrode sustain pulses to said second electrodes; an address drive circuit for generating and outputting address pulses based on a video signal and for driving said address electrodes; and a control-signal generation circuit for generating a control signal for changing said operating state of said second-electrode drive circuit, wherein, in order to display an image on said display panel, an address of a pixel on said display panel is specified by an electric field created between said second electrodes and said address electrodes by said scan pulses and said address pulses; a pixel on said display panel at an address specified by an electric field between said first electrodes and said electrodes created by said first-electrode sustain pulses and said second-electrode sustain pulses is turned on; and said second-electrode drive circuit is used for both specifying said address and for turning on said pixel.

3) A display apparatus for displaying an image on a display panel by turning on pixels of said display panel, the display apparatus comprising: said display panel provided with address electrodes and, first and second electrodes parallel to each other crossing said address electrodes and sandwiching electrical discharging units of pixels with said address electrodes; a first-electrode drive circuit for generating first-electrode sustain pulses for driving said first electrodes; a second-electrode drive circuit for generating scan pulses and second-electrode sustain pulses for driving said second electrodes, provided with a common circuit for generating said second-electrode sustain pulses or said scan pulses in response to an operating state thereof and for supplying said scan pulses and said second-electrode sustain pulses to said second electrodes; an address drive circuit for generating and outputting address pulses based on a video signal and for driving said address electrodes; a switch unit for selecting a scan power supply for generating said scan pulses or a sustain power supply for generating said second-electrode sustain pulses; and a control-signal generation circuit for generating a control signal for changing said operating state of said second-electrode drive circuit and controlling said switch device, wherein, in order to display an image on said display panel, an address of a pixel on said display panel is specified by an electric field created between said second electrodes and said address electrodes by said scan pulses and said address pulses; a pixel on said display panel at an address specified by an electric field between said first electrodes and said electrodes created by said first-electrode sustain pulses and said second-electrode sustain pulses is turned on; and said second-electrode drive circuit is used for both specifying said address and for turning on said pixel.

4) A display apparatus for displaying an image on a display panel by turning on pixels of said display panel, the display apparatus comprising: said display panel provided with address electrodes and, first and second electrodes parallel to each other crossing said address electrodes and sandwiching electrical discharging units of pixels with said address electrodes; a first-electrode drive circuit for generating first-electrode sustain pulses for driving said first electrodes; a second-electrode drive circuit for generating scan pulses and second-electrode sustain pulses for driving said second electrodes, provided with a common circuit for generating said second-electrode sustain pulses or said scan pulses in response to an operating state thereof and used for supplying said scan pulses and said second-electrode sustain pulses to said second electrodes; an address drive circuit for generating and outputting address pulses based on a video signal and for driving said address electrodes; a power collection circuit provided with a coil, a switch means and a capacitor and connected by a diode to outputs of said first-electrode drive circuit or said second-electrode drive circuit or both; and a control-signal generation circuit for generating a control signal for changing said operating state of said second-electrode drive circuit and an operating state of said switch device, wherein, in order to display an image on said display panel, an address of a pixel on said display panel is specified by an electric field created between said second electrodes and said address electrodes by said scan pulses and said address pulses; a pixel on said display panel at an address specified by an electric field between said first electrodes and said electrodes created by said first-electrode sustain pulses and said second-electrode sustain pulses is turned on; said second-electrode drive circuit is used for both specifying said address and for turning on said pixel; and on falling edges of said first-electrode sustain pulses or said second-electrode sustain pulses, said control-signal generation circuit puts said switch means employed in said power collection circuit in a conductive state, and resonance of said coil employed in said power collection circuit is used to establish a state to collect power from said first electrodes, said second electrodes or both in said capacitor employed in said power collection circuit.

DETAILED DESCRIPTION OF THE PREFERRED EMBODIMENTS

Figure 1:
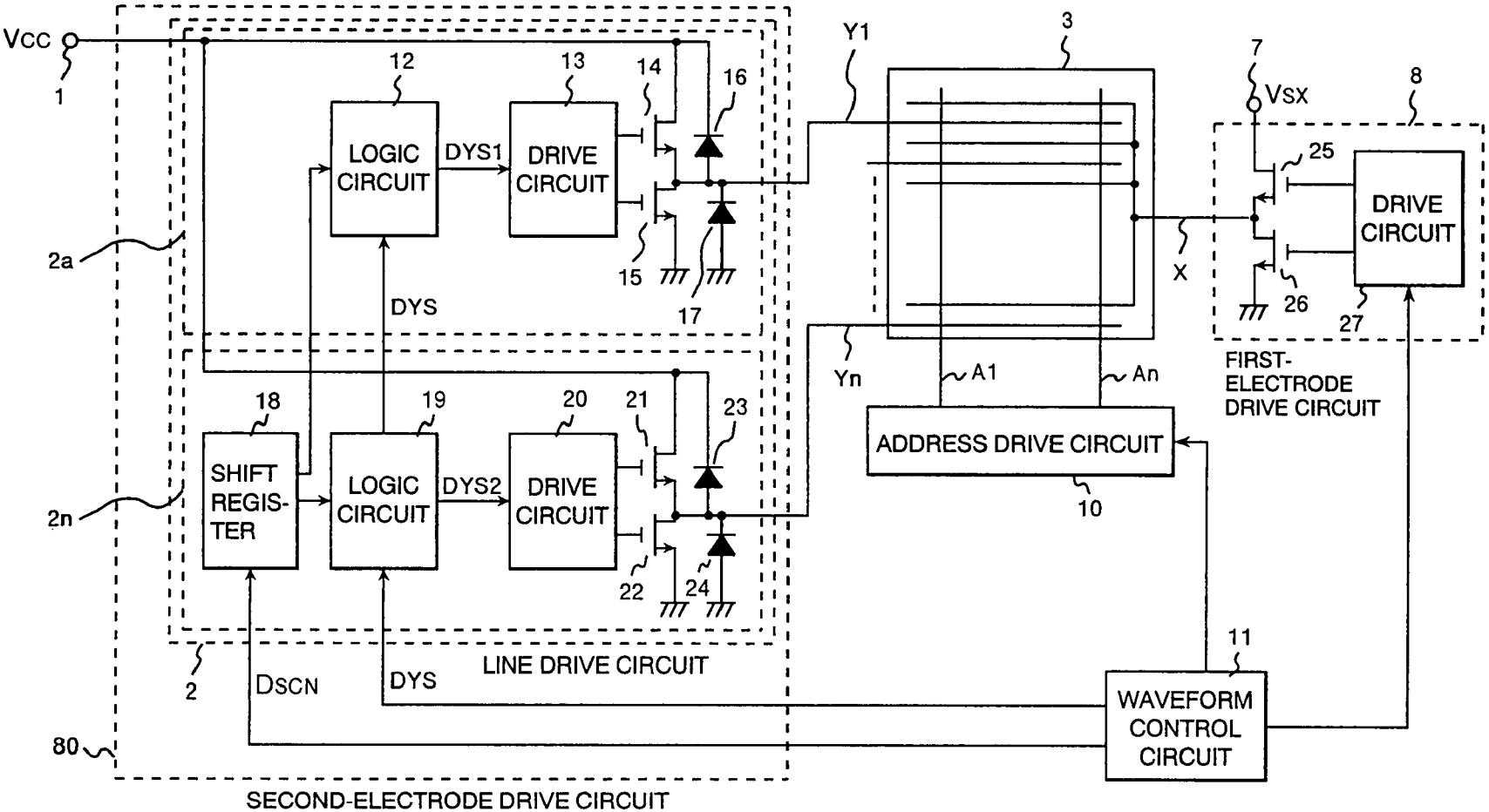
FIG. 1 is a block diagram showing a first embodiment implementing a display apparatus provided by the present embodiment.

Next, preferred embodiments of the present invention each implementing a plasma display apparatus are explained.

It should be noted that, in the drawings, components having identical functions are denoted by the same reference numeral in order to avoid duplication of explanation.

FIG. 1 is a block diagram showing a first embodiment implementing a display apparatus provided by the present embodiment. In FIG. 1, reference numerals 1 and 2 denote a line drive power supply input terminal and a line drive circuit respectively. Reference numeral 3 denotes a plasma display panel and reference notations Y1 to Yn each denote a second electrode. Reference notation X denotes a first electrode and reference numeral 7 denotes a sustain power supply of the first electrode X. Reference numeral 8 denotes a first-electrode drive circuit and reference notations A1 to An each denote an address electrode. Reference numerals 10 and 11 denote an address drive circuit and a waveform control circuit respectively. Reference numerals 12 and 19 each denote a logic circuit whereas reference numerals 13, 20 and 27 each denote a drive circuit. Reference numerals 14, 15, 21 and 22 each denote a power MOSFET whereas reference numerals 16, 17, 23 and 24 each denote a diode. Reference numerals 18 and 80 denote a shift register and a second-electrode drive circuit respectively.

As shown in FIG. 1, the second-electrode drive circuit 80 is a line drive circuit 2 comprising a first line drive circuit 2*a* to an nth line drive circuit 2*n* for electrode lines. The first line drive circuit 2*a* comprises a logic circuit 12, a drive circuit 13, power MOSFETs 14 and 15 and diodes 16 and 17. On the other hand, the nth line drive circuit 2*n* comprises a shift register 18, a logic circuit 19, a drive circuit 20, power MOSFETs 21 and 22 and diodes 23 and 24. The other line drive circuits have the same configurations. The shift register 18 of the nth line drive circuit 2*n* receives a scan signal Dscn from a waveform control circuit 11. On the other hand, the logic circuit 19 of the nth line drive circuit 2*n* receives sustain pulses DYS from the waveform control circuit 11. The power MOSFETs 14 and 21 employed in the line drive circuit 2 are each referred to as a first switch device. On the other hand, the power MOSFETs 15 and 22 employed in the line drive circuit 2 are each referred to as a second switch device.

Figure 2:
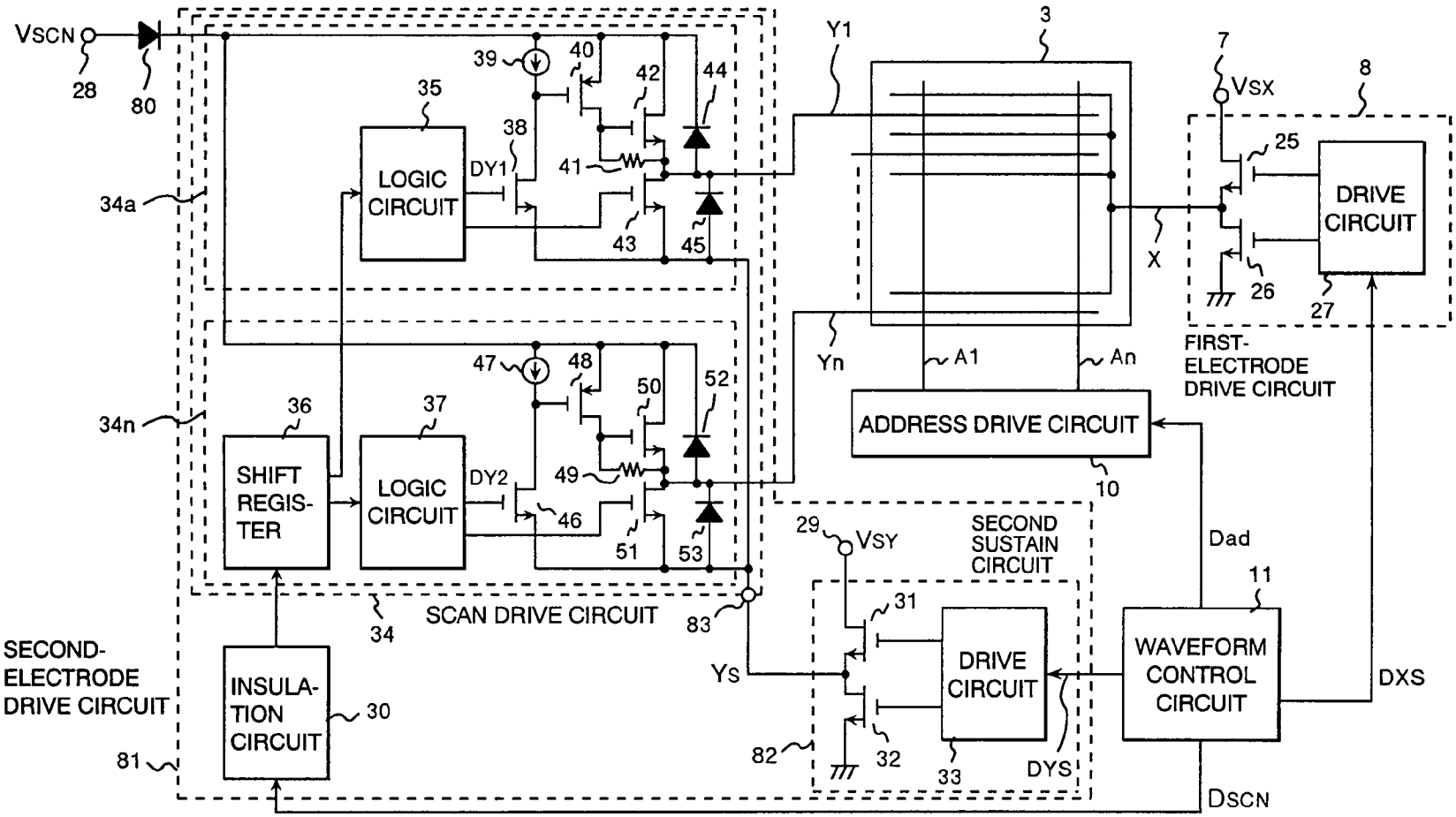
FIG. 2 (PRIOR ART)
FIG. 2 is a block diagram showing a typical configuration of the conventional display apparatus.

When compared with the conventional plasma display apparatus shown in FIG. 2, the embodiment of the present invention shown in FIG. 1 is different from the conventional display apparatus in that the embodiment includes neither the second-electrode sustain circuit 82 nor the insulation circuit 30 and, in the embodiment, the line drive circuit 2 generates both scan pulses and sustain pulses for the second electrodes Y1 to Yn.

The operation of the plasma display apparatus shown in FIG. 1 is explained as follows.

The scan signal Dscn output by the waveform control circuit 11 employed in the embodiment shown in FIG. 1 is supplied to the shift register 18 of the nth line drive circuit 2*n*. The scan signal Dscn is converted by the shift register 18 from a serial signal into a parallel signal. The parallel signal is supplied sequentially to the logic circuits 12 and 19 and the drive circuits 13 and 20 employed in the first to nth line drive circuits 2*a* to 2*n*. Then, the signal is amplified by the power MOSFETs 14 and 15 in the first line drive circuit 2*a* and the power MOSFETs 21 and 22 in the nth line drive circuit 2*n*. The amplified signal is supplied to the second electrodes Y1 to Yn as scan pulses.

Sustain pulses DYS generated by the waveform control circuit 11 of the display apparatus shown in FIG. 1 for the second electrodes Y1 to Yn are supplied to the drive circuit 20 by way of the logic circuit 19 and supplied to the drive circuit 13 by way of the logic circuits 19 and 12 of the line drive circuit 2. The sustain pulses DYS for the second electrodes Y1 to Yn are then amplified by the power MOSFETs 21, 22, 14 and 15. The amplified signal is supplied to the second electrodes Y1 to Yn as sustain pulses of the second electrodes Y1 to Yn.

The plasma display apparatus shown in FIG. 1 is characterized in that the scan pulses and the sustain pulses for the second electrodes Y1 to Yn are generated by a common circuit. Thus, the line drive circuit 2 shown in FIG. 1 is provided with both functions of the second-electrode sustain circuit 82 and the scan drive circuit 34 which compose the conventional plasma display apparatus shown in FIG. 2. As a result, the size of the plasma display apparatus shown in FIG. 1 is small in comparison with the conventional plasma display apparatus shown in FIG. 2.

The configuration of the line drive circuit 2 shown in FIG. 1 is similar to the scan drive circuit 34 shown in FIG. 2. In the line drive circuit 2, however, the current capacities of the drive circuits 13 and 20 and the power MOSFETs 14, 15, 21 and 22 and the switching speeds of the power MOSFETs 14, 15, 21 and 22 are set at values to give a large amplitude of the scan pulse supplied to the second electrodes Y1 to Yn and to supply sustain pulses resulting in a large discharge current to the second electrodes Y1 to Yn. In addition, the plasma display circuit shown in FIG. 1 is different from the conventional plasma display circuit shown in FIG. 2 in that, in the case of the former, the drive circuits 13 and 20 and the power MOSFETs 14, 15, 21 and 22 are operated by using the sustain pulses DYS of the second electrodes Y1 to Yn supplied to the logic circuit 19.

Comparison of operating waveforms of the plasma display apparatus shown in FIG. 1 with operating waveforms of the conventional plasma display apparatus shown in FIG. 2 is shown in FIG. 8.

Figures 8A, 8B, 8C, 8D, 8E, 8F, 8G, 8H, 8I, 8J, 8K, 8L, 8M, 8N, 8O:
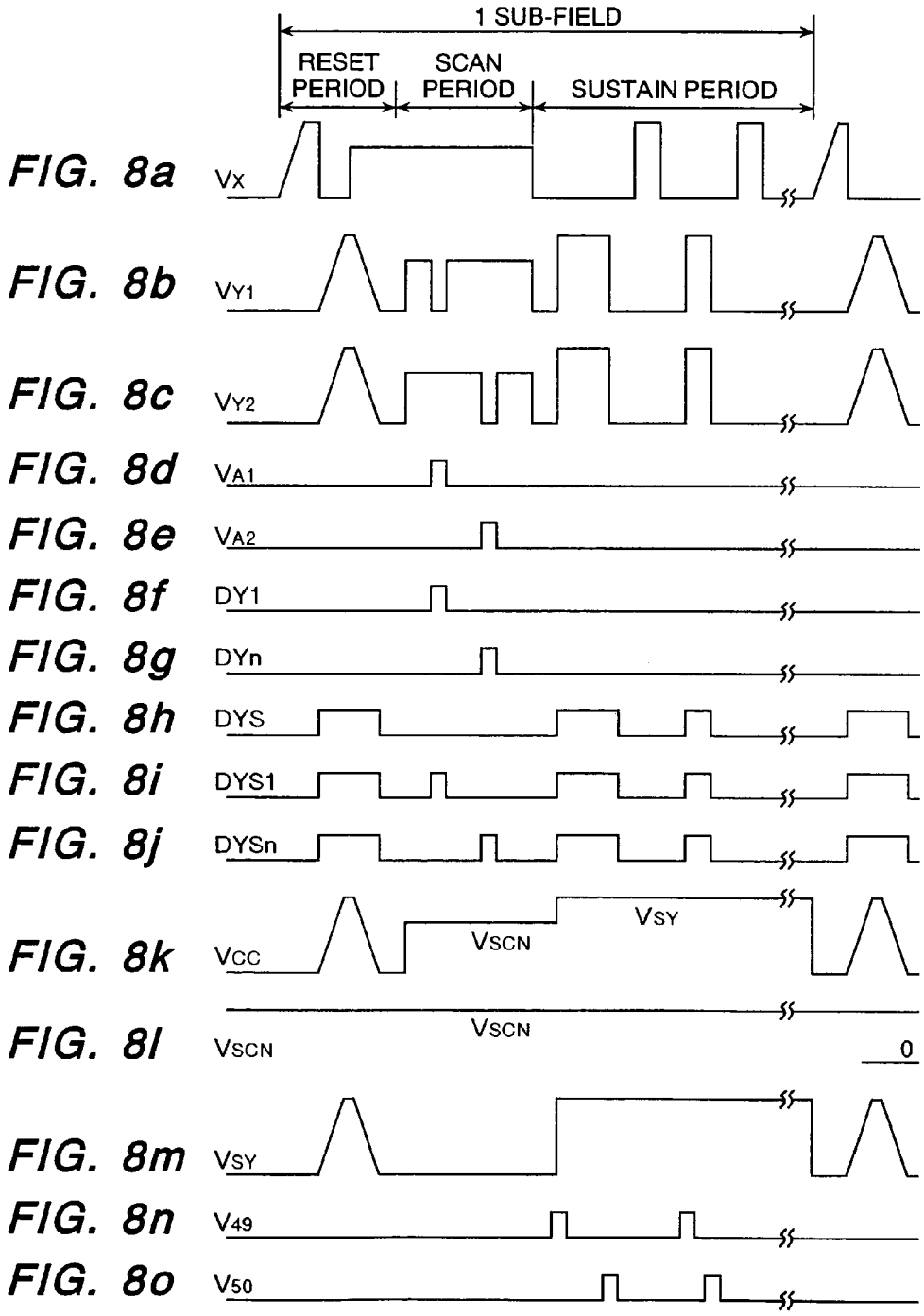
FIG. 8 is a diagram showing the waveforms of voltages supplied to the display apparatus.

FIG. 8 is diagrams showing the waveforms of voltages supplied to the plasma display apparatuses. To be more specific, FIG. 8A is a diagram showing the waveform of a voltage VX supplied to the first electrode X. FIG. 8B is a diagram showing the waveform of a voltage VY1 supplied to the first second electrode Y1. FIG. 8C is a diagram showing the waveform of a voltage VYn supplied to the nth second electrode Yn. FIG. 8D is a diagram showing the waveform of a voltage VA1 supplied to the first address electrode A1. FIG. 8E is a diagram showing the waveform of a voltage VA2 supplied to the nth address electrode An. FIG. 8F is a diagram showing the waveform of a voltage DY1 generated by the logic circuit 35 employed in the conventional plasma display apparatus shown in FIG. 2. FIG. 8G is a diagram showing the waveform of a voltage DYn generated by the logic circuit 37 employed in the conventional plasma display apparatus shown in FIG. 2. FIG. 8H is a diagram showing the waveform of sustain pulses YS of the second electrodes Y1 to Yn. FIG. 8 I is a diagram showing the waveform of a voltage DYS1 output by a logic circuit 12 shown in FIG. 1; FIG. 8J is a diagram showing the waveform of a voltage DYS2 generated by the logic circuit 19 of the plasma display apparatus of FIG. 1 provided by the present invention.

It should be noted that the rest of the waveforms shown in FIG. 8 is used for explaining other embodiments of the present invention. The other waveforms will be explained later.

The time axis of FIG. 8 is divided into a reset period, a scan period and a sustain period. The reset period is also referred to as a screen erase period and the scan period is also referred to as an address period. The sustain period is also referred to as an electrical-discharge sustain period. During the reset period, pulse voltages are applied to the first electrode X and the second electrodes Y1 to Yn alternately as shown in FIGS. 8A to 8C to cause an electrical discharge phenomenon over the entire screen. In the scan period following the reset period, a constant voltage is applied to the first electrode X as shown in FIG. 8A. In addition, negative pulses are subsequently supplied to the second electrodes Y1 to Yn as shown in FIGS. 8B and 8C. In addition, positive pulses (address pulses) are supplied subsequently to the address electrodes A1 to An, except cells not to be turned on in the sustain period, in order to select cells to be turned on in the sustain period as shown in FIGS. 8D and 8E. During the sustain period, a sustain voltage for sustaining an electrical discharge phenomenon is applied to the first electrode X and the second electrodes Y1 to Yn alternately as shown in FIGS. 8A to 8C.

In the conventional plasma display apparatus shown in FIG. 2, the logic circuits 35 and 37 output respectively the scan signal DY1 and DYn which are required during the scan period as shown in FIGS. 8F and 8G. As shown in FIG. 8H, the second-electrode sustain circuit 82 outputs the sustain pulses YS required during the sustain period. The sustain pulses YS are supplied to the second electrodes Y1 to Yn by way of the diodes 45 and 53.

In the case of this embodiment, on the other hand, the logic circuit 12 outputs a voltage DYS1 required during the scan period and the sustain period as shown in FIG. 8I. The voltage DYS1 is supplied to the first second electrode Y1. By the same token, the logic circuit 19 outputs a voltage DYSn required during the scan period and the sustain period as shown in FIG. 8J. The voltage DYSn is supplied to the nth second electrode Yn.

As described above, by generating the voltages DYS1 and DYSn at the outputs of the logic circuits 12 and 19 respectively in this embodiment, the second-electrode sustain circuit 82 and the scan drive circuit 34 of the conventional plasma display apparatus can be implemented in one line drive circuit 2.

Figure 3:
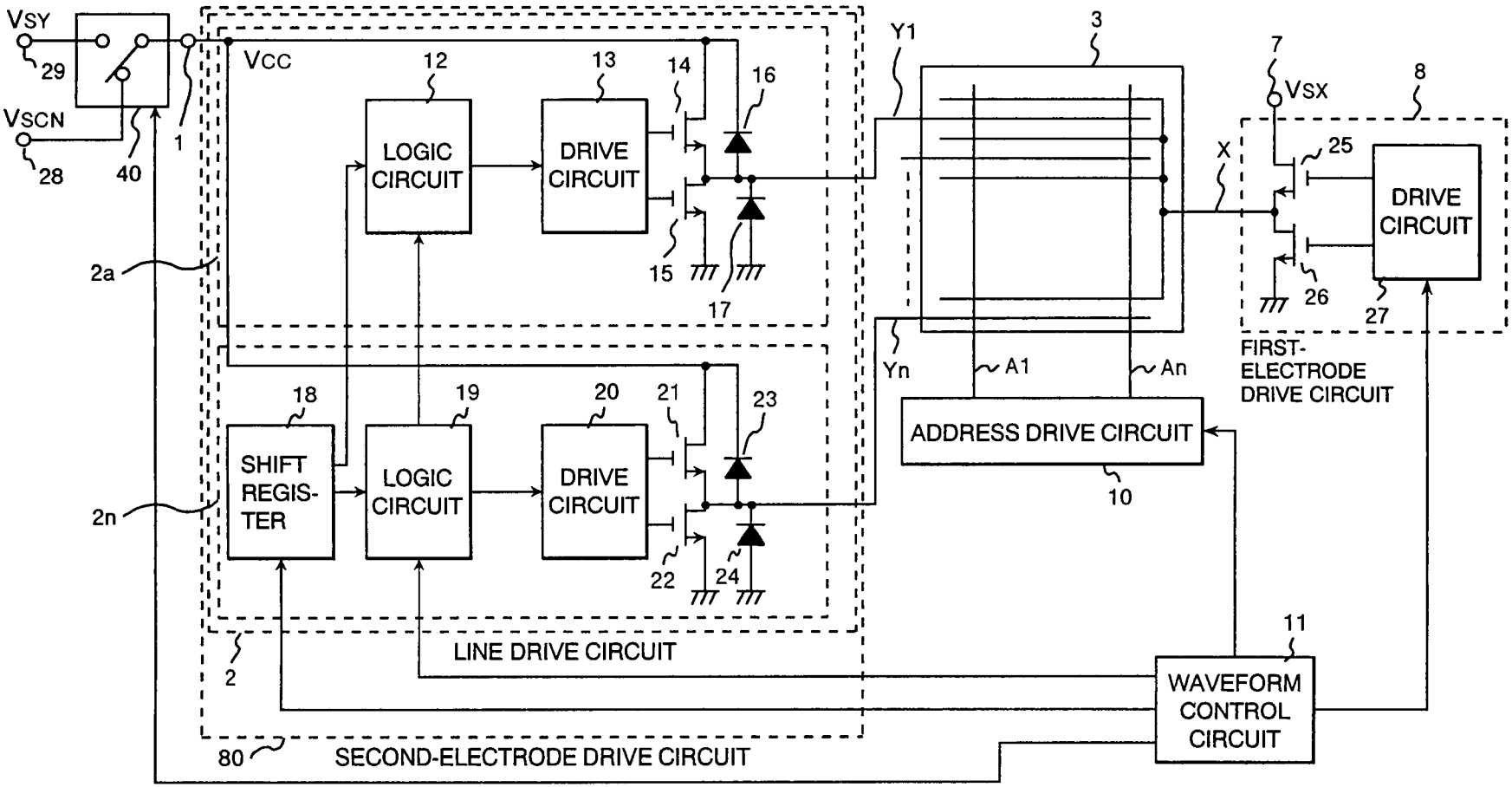
FIG. 3 is a block diagram showing a second embodiment implementing a display apparatus provided by the present embodiment.

FIG. 3 is a block diagram showing a second embodiment implementing a display apparatus provided by the present embodiment.

In the figure, reference numerals 28 and 29 denote a scan power-supply input terminal and a second-electrode sustain power-supply input terminal respectively. Reference numeral 40 is a switch means which is controlled by the waveform control circuit 11. The second embodiment is different from the first embodiment shown in FIG. 1 in that the former has the scan power-supply input terminal 28 and the second-electrode sustain power-supply input terminal 29 as well as the switch means 40. In the second embodiment shown in FIG. 3, the voltage Vcc of the line drive power supply is generated by the scan power supply Vscn or the sustain power supply Vsy which is selected by the switch means 40.

FIG. 8K is a diagram showing the waveform of the voltage Vcc of the line drive power supply. FIG. 8L is a diagram showing the waveform of the voltage Vscn of the scan power supply which is input from the terminal 28. FIG. 8M is a diagram showing the waveform of the voltage Vsy of the second-electrode sustain power supply. The switch means 40 is actuated to set the voltage Vcc of the line drive power supply at the voltage Vscn during a scan period for generating scan pulses. During other periods, the switch means 40 is actuated to set the voltage Vcc of the line drive power supply at the voltage Vsy. Thus, in this embodiment, a reset voltage generated during a reset period is superposed on the voltage Vsy of the sustain power supply for the second electrodes Y1 to Yn as shown in FIG. 8M. The switch means 40 is controlled typically as follows. The switch means 40 is initially connected to the terminal 28 to select the voltage Vscn. Then, the switch means 40 is changed over to the terminal 29 on the rising edge of the first sustain voltage appearing during a sustain period to receive the voltage Vsy. The switch means 40 is changed over back to the terminal 28 on the rising edges of the voltage of the second electrodes Y1 to Yn appearing during the sustain period.

According to the second embodiment of the present invention shown in FIG. 3, a voltage value of scan pulses supplied during a scan period can be set independently so that the amount of deterioration of a screen caused by an incorrect electrical discharge phenomenon can be reduced.

Figure 4:
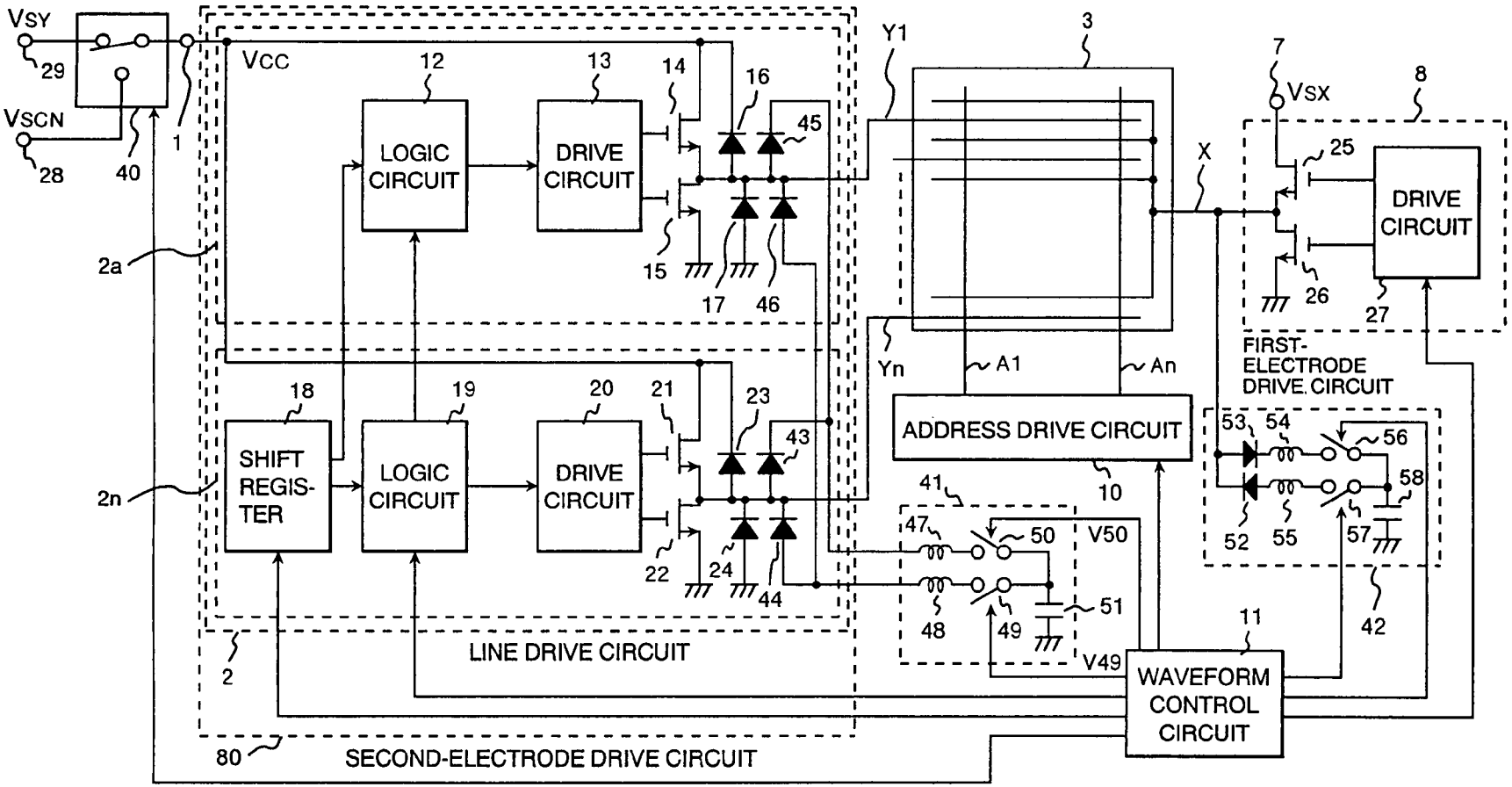
FIG. 4 is a block diagram showing a third embodiment implementing a display apparatus provided by the present embodiment.

FIG. 4 is a block diagram showing a third embodiment implementing a display apparatus provided by the present embodiment. The third embodiment is different from the second embodiment shown in FIG. 3 in that, the former is provided with a first-electrode power collection circuit 42 and a second-electrode power collection circuit 41. In FIG. 4, reference numerals 41 and 42 thus denote the second-electrode power collection circuit and the first-electrode power collection circuit respectively. Reference numerals 43, 44, 45, 46, 52 and 53 each denote a diode whereas reference numerals 47, 48, 54 and 55 each denote a coil. Reference numerals 49, 50, 56 and 57 each denote a switch means whereas reference numerals 51 and 58 each denote a capacitor. The second-electrode power collection circuit 41 comprises the coils 47 and 48, the switch means 50 and 49 and the capacitor 51. On the other hand, the first-electrode power collection circuit 42 comprises the coils 54 and 55, the switch means 56 and 57, the capacitor 58 and the diodes 53 and 52. Since the second-electrode power collection circuit 41 is provided in this way, the line drive circuit 2 thus also includes the diodes 43, 44, 45 and 46.

In the embodiment shown in FIG. 4, when first-electrode sustain pulses are applied to the first electrode X of the plasma display panel 3, the first-electrode power collection circuit 42 operates to reduce power losses incurred by the power MOSFETs 25 and 26 employed in the first-electrode drive circuit. In the first-electrode power collection circuit 42, the switch means 57 is put in a conductive state on the rising edge of a sustain pulse of the first electrode X. In this state, power is supplied from the capacitor 58 to the first electrode X by way of the coil 55 and the diode 52. On the other hand, the switch means 56 is put in a conductive state on falling edge of a first sustain pulse. In this state, power or electric charge is returned to the capacitor 58 by way of the diode 53 and the coil 54 from the stray capacitance of the first electrode X which is not shown in the figure. By virtue of the operation of the first-electrode power collection circuit 42, the magnitudes of the currents flowing through the power MOSFETs 25 and 26 can be decreased, allowing the power loss to be reduced. In the collection of power by the first-electrode power collection circuit 42, resonance caused by a circuit including the coils 54 and 55 and the stray capacitance of the plasma display panel 3 is utilized to suppress the power loss.

When sustain pulses of the second electrodes Y1 to Yn of the plasma display panel 3 are applied to the second electrodes Y1 to Yn, the second-electrode power collection circuit 41 operates to reduce power losses incurred by the power MOSFETs 14, 15, 21 and 22 employed in the first-electrode power collection circuit 42. The switch means 49 employed in the second-electrode power collection circuit 41 is put in a conductive state on the rising edges of sustain pulses supplied to the second electrodes Y1 to Yn. In this state, currents are supplied from the capacitor 51 to the second electrodes Y1 to Yn by way of the coil 48 and the diodes 44 and 46. On the other hand, the switch means 50 employed in the second-electrode power collection circuit 41 is put in a conductive state on the falling edges of sustain pulses supplied to the second electrodes Y1 to Yn. In this state, electric charge accumulated in the second electrodes Y1 to Yn is returned by way of the diodes 43 and 45 and the coil 47 to the stray capacitance of the plasma display panel 3.

By virtue of the operation of the second-electrode power collection circuit 41, the magnitudes of the currents flowing the power MOSFETs 14, 15, 21 and 22 can be decreased, allowing the power loss to be reduced. In the collection of power by the second-electrode power collection circuit 41, the power loss is suppressed by utilizing resonance caused by a circuit including the coils 47 and 48 and the stray capacitance of the plasma display panel 3 which is not shown in this figure.

FIG. 8N is a diagram showing the waveform of a switch-means driving voltage V49 supplied by the waveform control circuit 11 to a switch means 49 and FIG. 8O is a diagram showing the waveform of a switch-means driving voltage V50 supplied by the waveform control circuit 11 to a switch means 50.

As shown in FIG. 8N, the switch-means driving voltage V49 is a signal synchronized to the rising edges of sustain pulses supplied to the second electrodes Y1 to Yn. The switch-means driving voltage V49 turns on the switch means 49. In addition, as shown in FIG. 8O, the switch-means driving voltage V50 is a signal synchronized to the falling edges of sustain pulses supplied to the second electrodes Y1 to Yn. The switch-means driving voltage V50 turns on the switch means 50.

By providing the diodes 45, 46, 43 and 44 for the second electrodes Y1 to Yn on the line drive circuit 2 employed in the plasma display apparatus shown in FIG. 4, the second-electrode power collection circuit 41 can be applied, allowing the power loss incurred in the line drive circuit to be reduced. By employing high-speed devices with a turn-off time equal to or smaller than 500 ns as the power MOSFETs 14 and 21, the power MOSFETs 14 and 21 can be turned off with a high degree of reliability even if the source voltages of the power MOSFETs 14 and 21 are forcibly decreased. By collection of power and by employing high-speed devices as the power MOSFETs 14 and 21, it is possible to prevent the power MOSFETs 14 and 21 from being turned on even if voltages appearing at junction points of the diodes 45 and 46, that is, the source voltages of the power MOSFETs 14 and 21, are forcibly decreased. This is because no electric charge remains between the gate and the source of each of the power MOSFETs 14 and 21.

Figure 5:
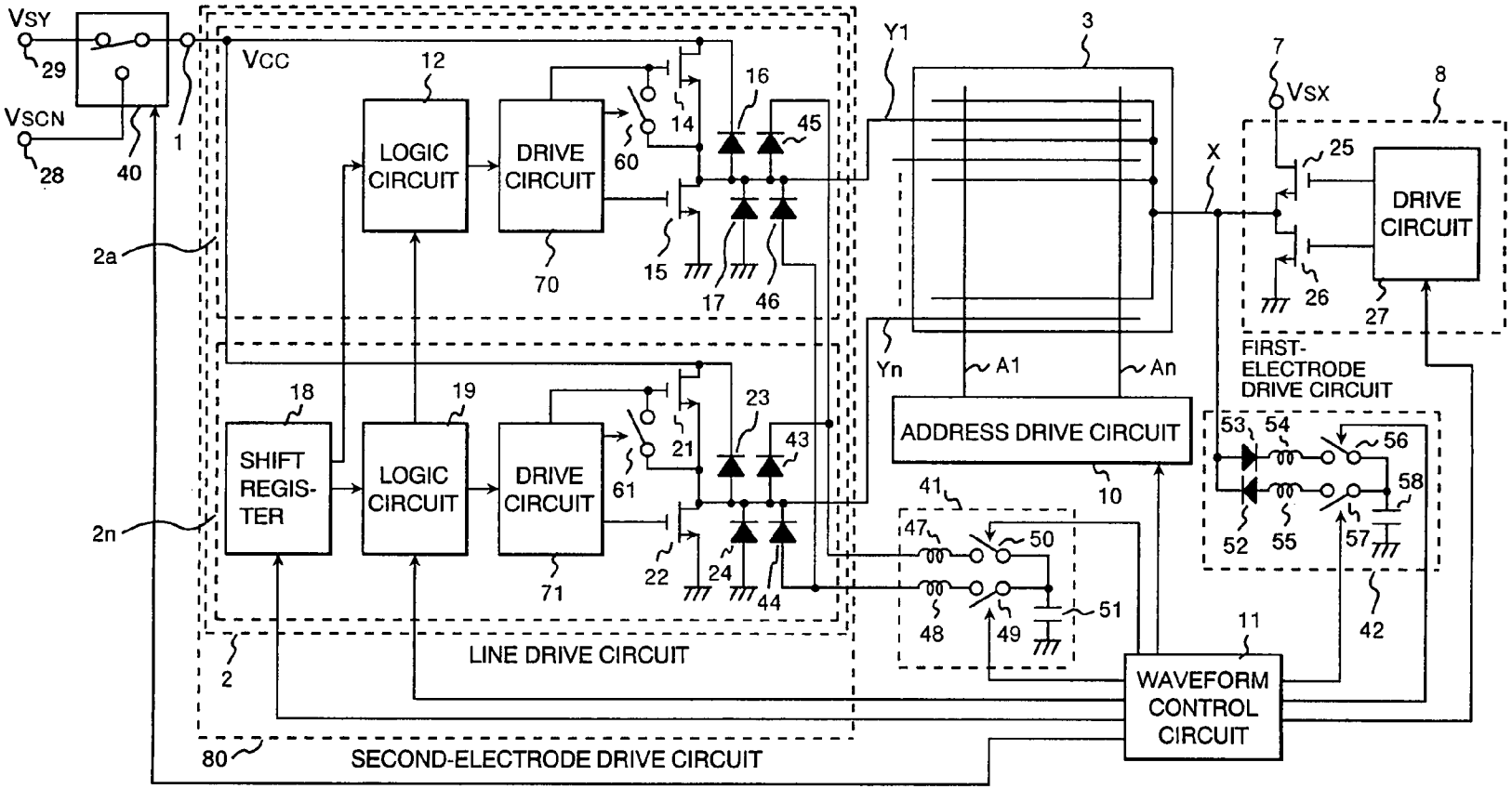
FIG. 5 is a block diagram showing a fourth embodiment implementing a display apparatus provided by the present embodiment.

FIG. 5 is a block diagram showing a fourth embodiment implementing a display apparatus provided by the present embodiment.

In the figure, reference numerals 60 and 61 each denote a switch means. The fifth embodiment is different from the fourth embodiment in that the former has switch means 64 and 65.

In the conventional plasma display apparatus shown in FIG. 2, in order to turn off the power MOSFETs 42 and 50 employed in the scandrive circuit 34, the power MOSFETs 40 and 48 at the preceding stage are turned off. At that time, electric charge accumulated between the gate and the source of each of the power MOSFETs 42 and 50 is electrically discharged through the resistors 41 and 49 respectively. With this circuit configuration adopted in the plasma display apparatus shown in FIG. 4, when the second-electrode power collection circuit 41 is operated to flow a current to the capacitor 51 by way of the diodes 45 and 43 from the stray capacitance of the plasma display panel 3 on the falling edges of the sustain pulses of the second electrodes Y1 to Yn, the source voltages of the power MOSFETs 14 and 21 employed in the line drive circuit 2 are forcibly lowered. As a result, a difference in electric potential is developed between the source and the gate of each of the power MOSFETs 14 and 21. It is thus quite within the bounds of possibility that the voltage between the source and the gate of each of the power MOSFETs 14 and 21 exceeds a threshold value, turning on the power MOSFETs 14 and 21.

In the fourth embodiment shown in FIG. 5, in order to prevent the power MOSFETs 14 and 21 from being turned on forcibly, the switch means 60 and 61 are provided between the gates and the sources of the power MOSFETs 14 and 21. By turning on the switch means 60 and 61 on the falling edges of the sustain pulses applied to the second electrodes Y1 to Yn, a circuit between the source and the gate of each of the power MOSFETs 14 and 21 is short-circuited, allowing the power MOSFETs 14 and 21 to be turned off at a high speed. Thus, by virtue of the second-electrode power collection circuit 41, it is possible to reliably prevent the power MOSFETs 14 and 21 from being turned on even if the source voltages of the power MOSFETs 14 and 21 are lowered forcibly.

Figure 6:
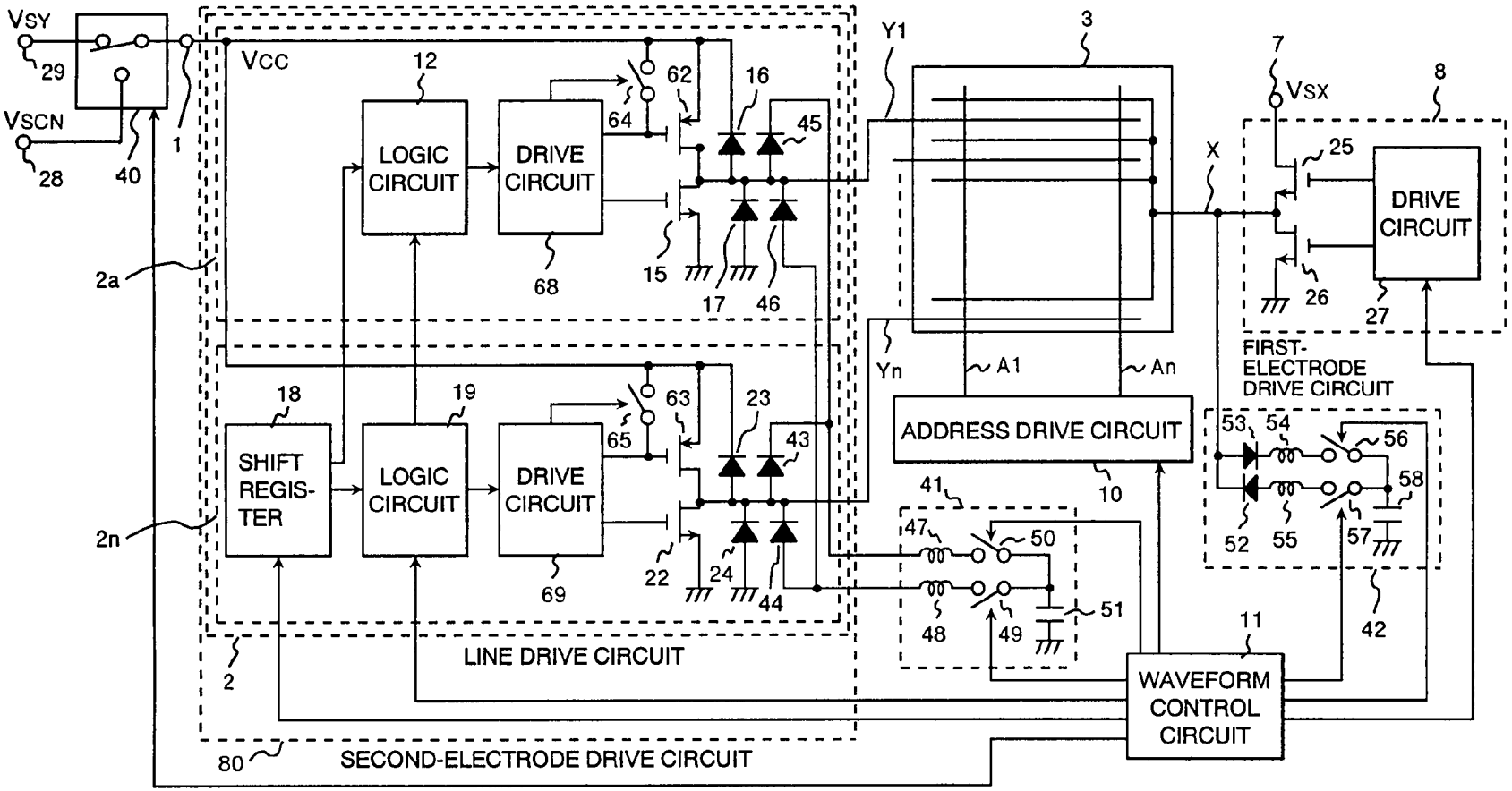
FIG. 6 is a block diagram showing a fifth embodiment implementing a display apparatus provided by the present embodiment.

FIG. 6 is a block diagram showing a fifth embodiment implementing a display apparatus provided by the present embodiment.

In the figure, reference numerals 62 and 63 each denote a P-channel power MOSFET whereas reference numerals 64 and 65 each denote a switch means. In the plasma display apparatus shown in FIG. 6, the P-channel power MOSFETs 64 and 65 are employed in place of the N-channel power MOSFETs 14 and 21 respectively while the switch means 60 and 61 are employed in place the switch means 64 and 65. Even if this circuit configuration is adopted, the second-electrode power collection circuit 41 is operated to flow a current to a capacitor 51 by way of diodes 45 and 43 from the stray capacitance of the plasma display panel 3 on the falling edges of the sustain pulses of the second electrodes Y1 to Yn. Thus, by turning on the switch means 64 and 65, the P-channel power MOSFETs 62 and 63 can each be turned off at a high speed even if the P-channel power MOSFETs 62 and 63 have been forcibly turned on. In this way, it is possible to reliably prevent the power MOSFETs 62 and 63 from being turned on by virtue of the second-electrode power collection circuit 41 even if the drain voltages of the power MOSFETs 62 and 63 are forcibly lowered. Thus, even in the case of an application using the fifth embodiment shown in FIG. 6, the same effects as those of the fourth embodiment shown in FIG. 5 can be obtained. In this embodiment, other means are used in place of the switch means 60, 61, 64 and 65 employed in the fourth and fifth embodiments to give the same effects. An example of the other means is a means for electrically discharging electric charge accumulated between the gate and the source of a power MOSFET at a high speed.

Figure 7:
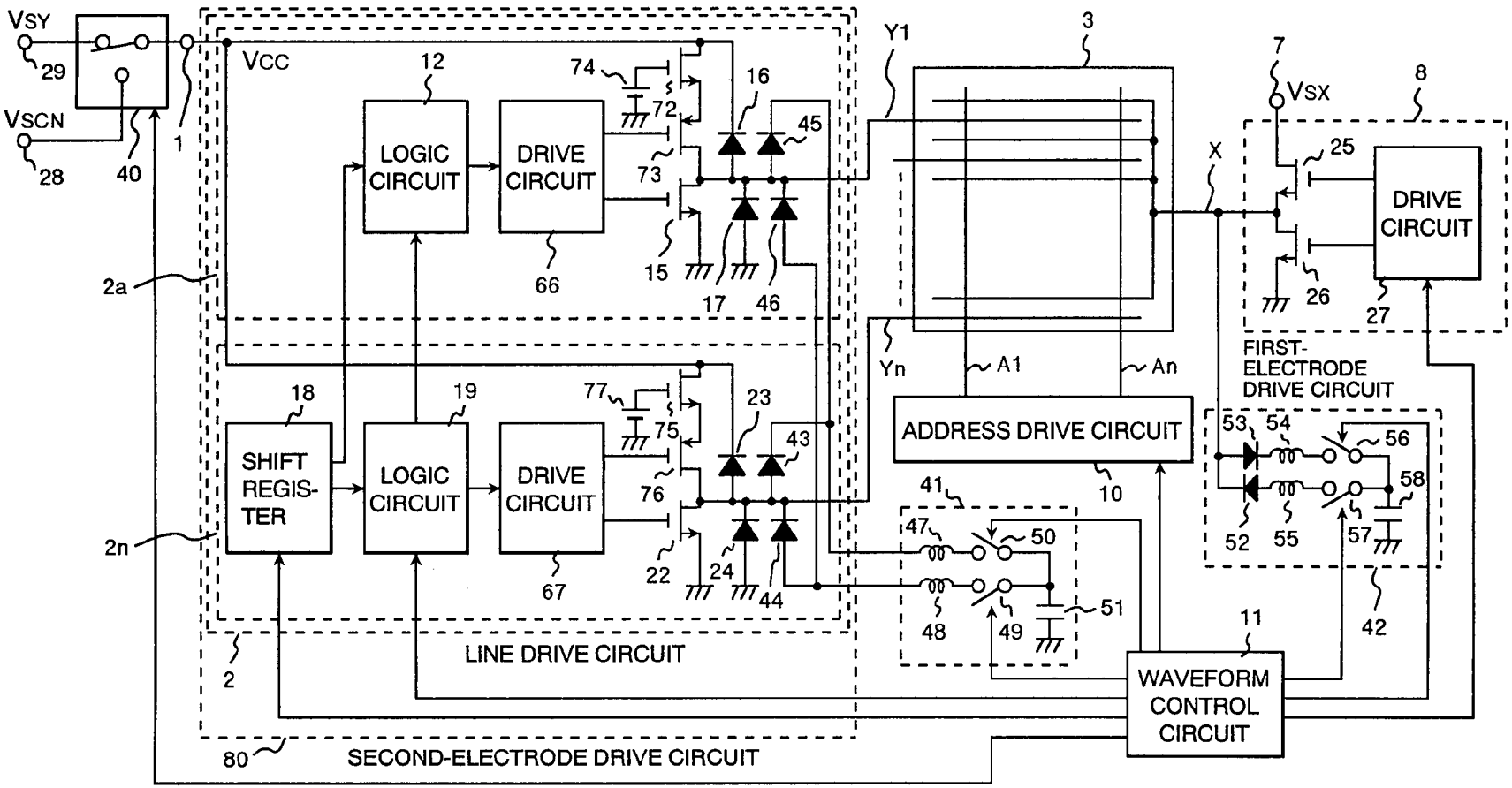
FIG. 7 is a block diagram showing a sixth embodiment implementing a display apparatus provided by the present embodiment.

FIG. 7 is a block diagram showing a sixth embodiment implementing a display apparatus provided by the present embodiment.

In the figure, reference numerals 73 and 76 each denote a P-channel power MOSFET whereas reference numerals 72 and 75 each denote an N-channel power MOSFET. Reference numerals 74 and 77 each denote a constant-voltage power supply. The sixth embodiment shown in FIG. 7 has a grounded-gate circuit comprising the power MOSFET 72, the constant-voltage power supply 74, the power MOSFET 75 and the constant-voltage power supply 77. In the plasma display apparatus shown in FIG. 7, the grounded-gate circuit is employed as the configuration of an output unit of the line drive circuit 2. In this configuration, the power MOSFETs 72 and 75 are turned on when the power MOSFETs 73 and 76 are turned on respectively. On the falling edges of sustain pulses of the second electrodes Y1 to Yn, a current flows from the stray capacitance of the plasma display panel 3 to the capacitor 51 by way of the diodes 45 and 43. In addition, the power MOSFETs 74 and 77 are held at a high impedance even if the drain voltages of the power MOSFETs 73 and 76 are lowered forcibly. Thus, by virtue of the second-electrode power collection circuit 41, the drain voltages of the power MOSFETs 73 and 76 are lowered forcibly and it is thus possible to reliably prevent the power MOSFETs 62 and 63 from being turned on.

In the embodiments described above, power MOSFETs are used in the line drive circuit 2. It should be noted, however, that the power MOSFETs can each be replaced by another switch device such as an IGBT.

In addition, power collection circuits can be provided by connecting them to the address drive circuit 10.

According to the present embodiment, the second-electrode drive circuit has 2 functions, namely, a function to generate scan pulses and a function to generate sustain pulses of the second electrodes Y1 to Yn. By executing the 2 functions through the use of a common circuit in this way, the configuration of the second-electrode drive circuit can be made simple.

Furthermore, the present invention can also be implemented by another embodiment different from the embodiments described so far without departing from the true spirit and main characteristics of the present invention. That is, all the embodiments described above are no more than examples of the present invention and should not be interpreted as limitations on the present invention. The scope of the present invention is defined by claims appended to this specification. Moreover, modifications and changes pertaining to an average range of the range of each claim are considered to be included in the scope of the present invention.

What is claimed is:

1. A display apparatus for displaying an image on a display panel, said display apparatus comprising:

a display panel provided with a plurality of first electrodes, a plurality of second electrodes arranged parallel to said first electrodes and a plurality of address electrodes arranged so as to cross to said first and second electrodes;

a first electrode drive circuit supplying first electrode sustain pulses to said plurality of first electrodes;

a second electrode drive circuit supplying scan pulses and second electrode sustain pulses to said plurality of second electrodes;

an address drive circuit supplying address pulses based on the image to said plurality of address electrodes; and wherein said second electrode drive circuit includes a plurality of line drive circuits connected to said plurality of second electrodes respectively, and each of the line drive circuits has a driving switch for supplying said second electrode sustain pulses to the corresponding second electrode selectively, wherein said driving switch also supplies said scan pulses to said corresponding second electrode selectively, and wherein said driving switch includes:

a first switch element which supplies high level voltage of said second electrode sustain pulses and high level voltage of said scan pulses to said corresponding second electrodes, and a second switch element which supplies low level voltage of said second electrode sustain pulses and low level voltage of said scan pulses to said corresponding second electrodes.

2. The display apparatus according to claim 1, wherein a power collection circuit is provided for said plurality of line drive circuits in common, and said power collection circuit includes a capacitor and a coil connected between said plurality of line drive circuits and said capacitor.

* * * * *